United States Patent [19]

Sutter

[11] 4,320,875

[45] Mar. 23, 1982

[54] BURNER NOZZLE

[75] Inventor: Franz Sutter, Niederdorf, Switzerland

[73] Assignee: Institut Straumann AG, Switzerland

[21] Appl. No.: 111,002

[22] Filed: Jan. 10, 1980

[30] Foreign Application Priority Data

Jan. 15, 1979 [CH] Switzerland ..... 352/79

[51] Int. Cl.[3] ..... F23D 11/38

[52] U.S. Cl. ..... 239/462; 239/497

[58] Field of Search ..... 239/403, 462, 463, 491–497

[56] References Cited

U.S. PATENT DOCUMENTS

| | | | |
|---|---|---|---|
| 2,009,932 | 7/1935 | Klotzman | 239/493 |
| 2,508,788 | 5/1950 | Hallinan | 239/496 X |

FOREIGN PATENT DOCUMENTS

| | | | |
|---|---|---|---|
| 2441833 | 3/1976 | Fed. Rep. of Germany . | |
| 553379 | 8/1974 | Switzerland | 239/403 |
| 194040 | 3/1923 | United Kingdom | 239/493 |

*Primary Examiner*—Andres Kashnikow

*Attorney, Agent, or Firm*—McGlew and Tuttle

[57] ABSTRACT

A burner nozzle comprises an outer body (21) having a longitudinal hole (21*a*) therethrough. Screwed into the hole is a pin (27) applying by one of its ends against a vortex body (25) and pressing the latter into contact with the inner front side of a nozzle body (21) having a nozzle orifice (23*a*). The vortex body (25) is provided with channels which connect an annular cavity (43) surrounding the vortex body (25) to a vortex pocket (45). The pin (27) is provided with an oblong hole (27*g*) for the fuel supply. In the vicinity of the vortex body (25), this oblong hole (27*g*) communicates, through radial bores (27*h*), with another annular cavity (41) which is bounded by the inside surface of the outer body (21) and by an annular groove (27*c*) provided in the pin (27). The pin portion (27*d*) extending between the two annular cavities is provided with a circular row of grooves having a sectional area which is smaller than that of the vortex body channels. During operation, these grooves (27*e*) prevent dirt particles from passing to and clogging the channels.

25 Claims, 8 Drawing Figures

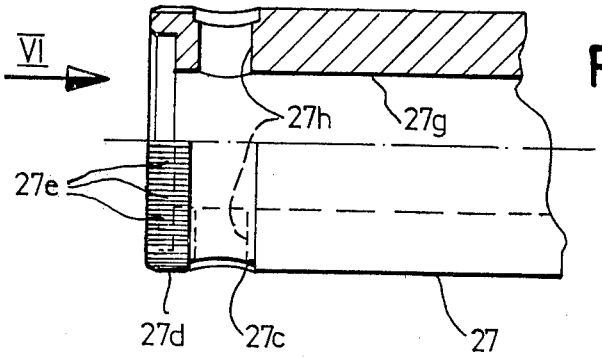
Fig. 5
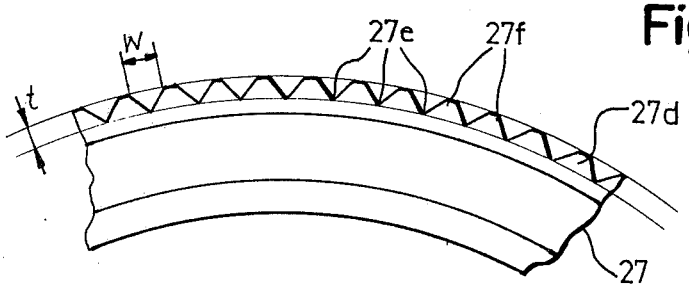
Fig. 6
Fig. 7
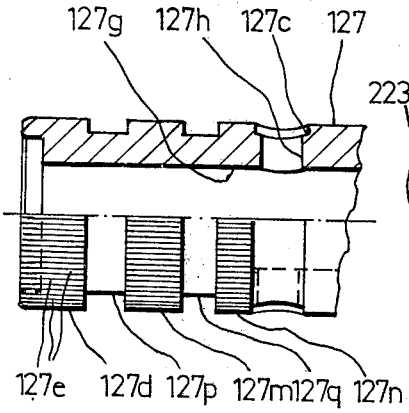
Fig. 8
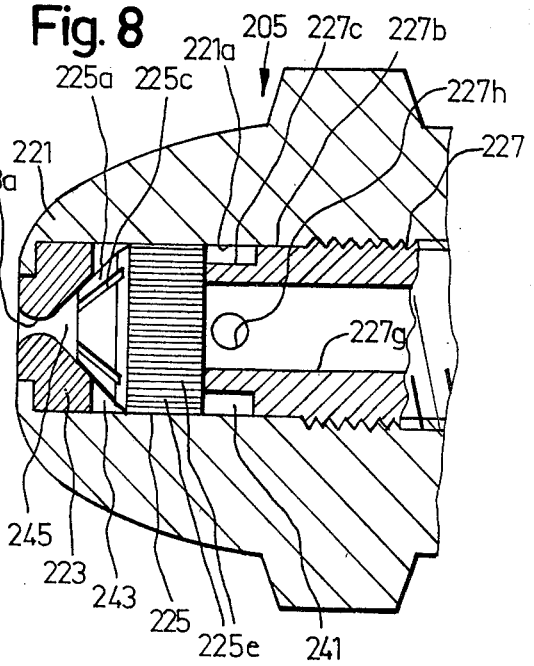

BURNER NOZZLE

FIELD AND BACKGROUND OF THE INVENTION

The invention relates to a burner nozzle comprising an outer body having a longitudinal hole therethrough, a nozzle body which is inserted in the end portion of the longitudinal hole and has a coaxial nozzle orifice, with a vortex pocket provided at the inner end of the nozzle orifice communicating, through at least one channel, with a first annular cavity extending at the outer end of the channel or channels, and a pin which is inserted in the longitudinal hole of the outer body and bounds a passage for supplying fuel to the nozzle body.

From Swiss Pat. No. 553,379, there is known an oil burner with a burner nozzle comprising an axially symmetrical outer body tapering toward the nozzle tip. In the tip of the outer body, a nozzle plate is inserted having a nozzle orifice at its center. Adjoining the nozzle plate is a vortex body whose contacting surface is provided with channels which extend from the outer edge of the vortex body to the area of the nozzle orifice. The vortex body is pressed into contact with the nozzle plate by a hollow pin which is snugly screwed into the outer body. An annular gap is provided between the front end of the pin and of the vortex body and the inside surface of the outer body. On its front end, the pin is further provided with slots through which, during operation, the oil can flow from the oblong hole of the pin into said annular gap. Then, the oil flows through the slot to the outer ends of the channels provided in the vortex body. The pin end remote from the nozzle plate is provided with radial bores opening into the oblong hole thereof. In the zone of these radial bores, the pin is surrounded by a fine-meshed screen. During operation, the oil passes through the screen serving as filter and through the radial bores into the oblong hole of the pin.

Thus, during operation of this prior art burner nozzle, the oil is filtered through the screen surrounding the rear portion of the pin. Experience has shown, however, that in spite of this arrangement, dirt still passes to the channels of the vortex body and may cause their clogging. This is the case particularly with burner nozzles which are intended for relatively low heating capacities and in which the channels of the vortex body have correspondingly small sectional areas. For example, for heating equipments of small single-family houses, and of vehicles, burners are needed in which the channels have widths and depths in the magnitude of 0.12 to 0.3 mm.

Attempts have already been made to prevent a clogging of the channels by providing a collar at the front end of the pin of the prior art burner disclosed in Swiss Pat. No. 553,379. The collar has been dimensioned to obtain a radial width of the annular gap between the inside surface of the outer body and the collar, in the zone of the collar,in the magnitude of 0.1 mm, so that dirt particles also be held back. This design of the oil burner did reduce the frequency of clogging the channels. However, tests have shown that dirt particles, particularly fibre-like particles, still penetrate to the channels of the vortex body and may cause clogging. Further known, from German Offenlegungschrift No. 24 41 833, is a burner nozzle having a hollow outer body in which, at one of its ends, a substantially disc-shaped body and a vortex body with a channel for producing turbulence are inserted. On the vortex body side remote from the nozzle body, a hollow bolt with a stepped outer surface is provided which is screwed into the outer body. An annular gap is provided between the outer surfaces of the nozzle body, of the vortex body, and of the adjoining end of the hollow bolt and the inside surface of the outer body. The bolt end adjoining the vortex body is provided with radial ports connecting the cavity to the annular gap. A filter in the form of a cylindrical sleeve surrounds the bolt end provided with the radial ports, the vortex body, as well as a portion of the nozzle body, and applies against their outer surfaces. The oil to be burned is supplied through the hollow of the bolt and passes through the radial ports of the bolt and said annular gap into the channel of the vortex body, and is to be filtered by the filter.

The filter of a burner nozzle designed in accordance with the German Offenlegunschrift No. 24 41 833 and known to the inventor is made from a metal gauze which certainly is cut out of a piece of gauze and then welded to a sleeve. Thus, the prior art burner nozzle has the disadvantage that a separate filter must be made of a wire mesh and engaged on the nozzle body, the vortex body, and the end of the bolt. Since the filter must be very fine-meshed to perform its function, its manufacture and engagement on the parts is relatively time consuming and very exacting. In addition, it is hardly possible to engage the filter on the nozzle body, the vortex body, and the bolt in such a way as to ensure everywhere a close fit and to prevent dirt particles from escaping past the filter edges. In particular, since the filter is provided with a weld which necessarily increases thickness and causes rigidity, there is a great chance that the filter will not perfectly apply in the area of the weld and that dirt particles will there be allowed to escape. Moreover, the weld itself also may have defective spots where dirt particles may penetrate through. Further, there is a considerable risk that during the cutting of the wire mesh and engaging of the filter, the wires forming the filter will partly be cut through or otherwise damaged and that later, during operation, wire lengths will break off and clog the channel of the vortex body.

Another disadvantage of the burner nozzle known from German Offenlegungschrift No. 24 41 833 results from the fact that the heating oil usually contains semi-solid, paraffinic particles. In general, these particles are about ball-shaped and may temporarily be deformed. While temporarily so deformed, they might pass through an aperture of a lattice filter, even though in their initial spherical shape, they have a diameter exceeding the size of the filter aperture. If such particles pass into a channel serving to produce turbulence and having a clear cross section smaller than the ball diameter, but being substantially longer than the ball diameter, particles frequently can no longer deform to a sufficient extent to pass through the channel and cause clogging.

SUMMARY OF THE INVENTION

The invention is directed to a burner nozzle in which a clogging of the channels is prevented as securely as possible, even if a vortex body is used having channels of a very small sectional area. In spite of that, the burner nozzle must be easy to assemble and, in particular, the necessity of manufacturing and mounting a filter as a separate component part is to be eliminated. This problem is solved by providing a burner nozzle of the kind mentioned above and having the features set forth in claim 1. Further particularly advantageous embodiments of the invention follow from the dependent claims.

The inventive burner nozzle comprises at least one filter which is formed by a circular row of grooves. Advantageously, the length of the grooves is at least three times, preferably five times, and, for example, 10 to 20 times, their width as well as their depth. This makes sure with a great probability that the filter will prevent the passage therethrough also of paraffinic and other deformable particles which might clog the vortex channels.

The grooves of the filter of the inventive burner nozzle also provides another advantage over the lattice-type filter of German Offenlengunschrift No. 24 41 833. That is, the grooves increase the friction and, consequently, the temperature of the fuel oil flowing therethrough, with the result that the volume of the oil slightly increases prior to reaching the vortex channels. This reduces the density and the specific calorific value which is related to the volume. In addition, the frictional effects in the grooves increase the drop in pressure. For these reasons, and with a definite predetermined nominal performance of the burner, the grooves make it possible to enlarge the cross section of the channels, which further reduces the risk of clogging.

In accordance with the invention, a burner nozzle is provided which includes an outer body having a longitudinal bore extending therethrough from an entrance end to an exit end for passing a fuel therethrough. A nozzle body is mounted in the bore adjacent to the exit end. The nozzle body has an orifice coaxially disposed in respect to the axis of the longitudinal bore for passing the fuel. A vortex body is mounted in the bore spaced from the outer body to provide a first annular cavity between the outer body and the periphery of the vortex body. The vortex body has a front face designed for reception on the nozzle body. The front face includes a tapering pocket immediately adjacent to and in alignment with the orifice and a channel interconnecting the first annular cavity and the tapering pocket. A pin member is mounted in the bore. The pin member has a passage for supplying fuel to the nozzle body. The pin member also has an annular groove near an end thereof adjacent to the vortex body to provide a second annular cavity between the outer body and the periphery of the pin member. The pin member has a surface portion intermediate the second annular cavity and the first annular cavity which contacts a surface portion of the outer body which bounds the longitudinal bore. One of the surface portions has a plurality of grooves interconnecting the first cavity and the second cavity.

BRIEF DESCRIPTION OF THE DRAWINGS

In the following, the subject matter of the invention is explained by referring to the embodiment shown in the drawings, where

FIG. 5 is a view, enlarged relative to FIG. 2, of the front end of the pin, carrying the circular row of grooves;

FIG. 6 is a top plan view, still enlarged relative to FIG. 5, of the end of the pin, taken in the direction of arrow VI of FIG. 5;

FIG. 7 shows a variant of a burner nozzle in which a circular row of grooves is provided on the vortex body; and FIG. 8 is a longitudinal sectional view of a burner nozzle in which the circular row of grooves serving the purpose of filtering is provided on the vortex body.

DETAILED DESCRIPTION OF THE INVENTION

Figure 1:
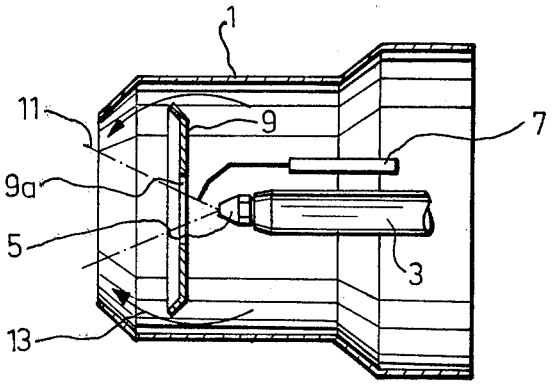
FIG. 1 is a longitudinal sectional view of a burner head accommodating a burner nozzle.

The burner head shown in FIG. 1 comprises a flame tube 1 accommodating a burner nozzle 5 which is secured to a burner rod 3, an ignition electrode 7, and a baffle plate 9. The baffle plate has an aperture 9*a* which is coaxial with burner nozzle 5.

Figure 2:
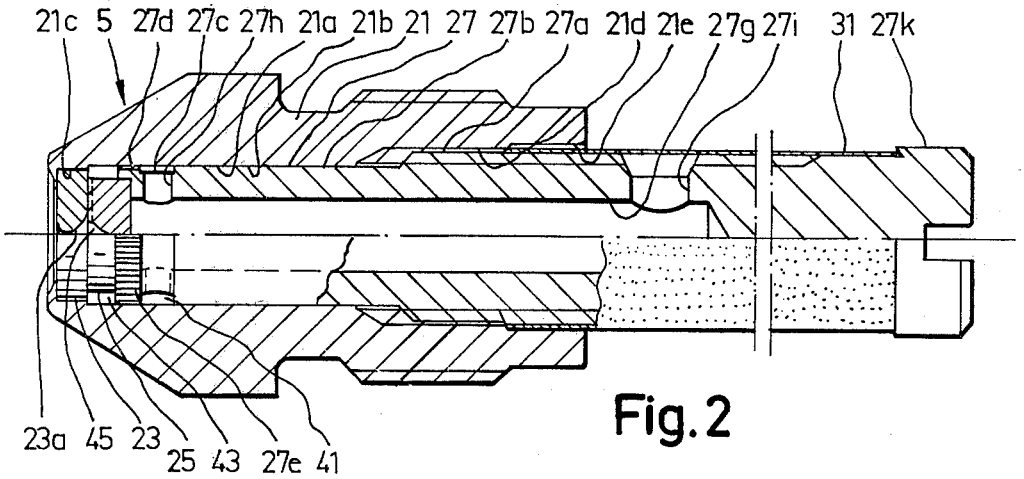
FIG. 2 is an enlarged longitudinal sectional view of a burner nozzle.

Burner nozzle 5, separately shown in FIG. 2, comprises a metallic, substantially rotationally symmetrical outer body 21 which conically tapers toward its end forming the tip of the burner nozzle and is provided, close to its other end, with an external thread by which it can be screwed into burner rod 3 which has a longitudinal hole for receiving the externally threaded end. Outer body 21 is provided with a coaxial longitudinal hole or bore 21*a* extending therethrough. Hole 21*a* includes a circularly cylindrical, main midportion 21*b* which is followed, in the vicinity of the conical end of the outer body, by a cylindrical portion 21*c* having a slightly smaller diameter and being limited, on its end remote from midportion 21*b*, by a radial shoulder face. At the side of the midportion 21*b* remote from the conical end, a slightly wider tapped hole portion 21*d* is provided. The opposite end 21*e* of hole 21*a*, remote from the conically tapered end of the outer body, is again circularly cylindrical and has a slightly larger diameter than the tapped portion.

In hole portion 21*c*, a disc-shaped nozzle body 23 is inserted having a circular contour and being provided with an orifice 23*a* which extends therethrough and is coaxial with the axis of rotational symmetry of outer body 21. Orifice 23*a* is necked in its mid-portion and enlarges to both sides. Nozzle body 23 is followed by an also disc-shaped vortex body 25 having a circularly cylindrical outer contour.

Figure 3:
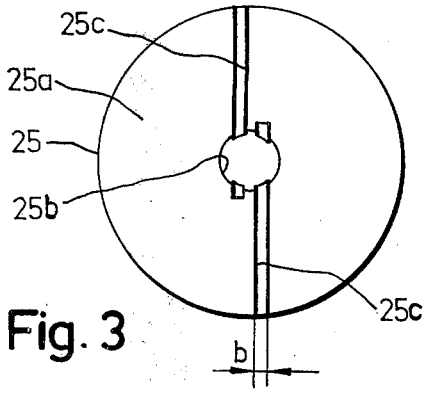
FIG. 3 is a top plan view still enlarged relative to FIG. 2 of the front face of the vortex body which is provided with the channels.
Figure 4:
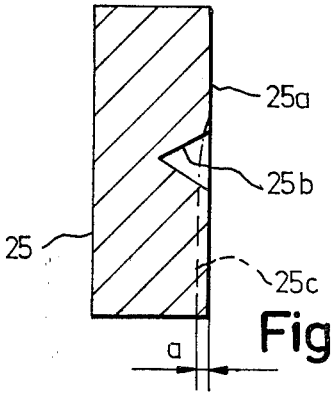
FIG. 4 is a section taken across the vortex body shown in FIG. 3.

The radial front face 25*a* of vortex body 25, which is received on, that is, applies against nozzle body 23, is provided, at its center, with a conically tapering pocket hole 25*b*, as best shown in FIGS. 3 and 4, adjacent to and in alignment with the orifice 23*a*. Two extend from the outer circumference of the vortex body 25 and open into the pocket hole. The two channels 25*c* are symmetrical relative to the center of the vortex body, however, they do not extend radially, but are tangential to an imaginary circle which is coaxial with the vortex body axis. Channels 25*c* have a rectangular cross section and their depth measured parallel to the longitudinal axis of burner nozzle 5 is indicated at a and their widths measured perpendicularly thereto is indicated at b. The outer diameter of the vortex body 25 is smaller than the inner diameter of the main hole portion 21*b* into which the vortex body is inserted. Therefore, an annular cavity 43 is formed in the zone of the peripheral ends of channels 25*c*, between the circumferential surface of vortex body 25 and the inside surface of outer body 21.

Burner nozzle 5 further comprises a substantially cylindrical pin 27 which is provided with an external thread 27*a* extending over a part of the pin length and screwed into the tapped hole portion 21*d* of outer body 21. The end of pin 27 which is enclosed in outer body 21 is provided with a recess forming a seat for a portion of vortex body 25 whose front face 25*a* is pressed by the pin into in some degree tight contact with nozzle body 23. In the direction of vortex body 25, external thread 27*a* is followed by a portion 27*b* which has a circularly cylindrical outer surface and whose diameter is approximately equal to the inner diameter of main portion 21*b* of hole 21 of the outer body. Near the pin end facing the vortex body, portion 27*b* is followed by an annular groove 27*c*. On its outermost end portion, the end portion proper 27*d* facing the vortex body of the pin is provided with a conical taper, and on its cylindrical outer surface, with a circular row of grooves 27*e*.

Grooves 27*e*, which are best shown in FIG. 5 and 6, are bounded by teeth and uniformly distributed over the circumference of pin 27, and they are provided in a number of at least thirty, and preferably about ninety. Grooves 27*e* extend parallel to the longitudinal axis of symmetry of burner nozzle 5. Grooves 27*e* have a triangular cross-section with the vertex at their bottom. The depth of the grooves measured between their deepest point and the envelope 29 is indicated at t in FIG. 6. The maximum widths of the grooves measured tangentially of the envelope is indicated at w in FIG. 6.

Pin 27 is further provided with a coaxial blind bore 27*g* which is drilled from its side facing the vortex body. In the pin portion projecting from outer body 21, two diametrally opposite, radial bores 27*i* are provided which open into blind bore 27*g*. Two other radial, diametrally opposite bores 27*h* connect blind bore 27*g* to the annular cavity 41 which is bounded by groove 27*c* and the inner surface of outer body 21.

An unthreaded rear end portion 27*k* of the pin, projecting from outer body 21, is slightly thicker than the adjoing threaded pin portion 27*a*, and is provided with a cross slot, thus forming a screw head. Further provided on the rear portion of pin 27 is a fine-meshed metal lattice or screen 31 embracing this portion. The screen extends from the shoulder formed by the pin end portion 27*k* into the hole portion 21*e* of the outer body thus covering particularly the outer openings of radial bores 27*i*.

Burner rod 3 as already mentioned, is provided with a longitudinal hole into which outer body 21 is screwed. Between the pin portion projecting from the outer body and embraced by screen 31 and the inside surface bounding the longitudinal hole of burner rod 3, a passage having a circular cross section is formed through which, during operation, the fuel to be burned is supplied. The external thread 27*a* and the cylindrical portion 27*b* of the pin, along with the corresponding opposite surfaces of outer body 21 provide a joint by which, in practice, the fuel passage is tightly sealed off. In the same way, the opening of blind hole 27*g* is practically sealed off by vortex body 25. Further, nozzle body 23 tightly seals the longitudinal hole 21*a* of the outer body towards the outside. Consequently, the fuel flows through screen 31 serving as filter into bores 27*i* and through blind bore 27*g* and the bores 27*h* into the annular cavity 41 bounded by groove 27*c* and the inside surface of the outer body. Therefrom, the fuel passes through grooves 27*e* into the annular cavity 43 which is formed between the circumferential surface of vortex body 25 and the inside surface of outer body 21. Thereupon, the fuel flows through channel 25*c* into the vortex space 45 which is bounded by the conical pocket hole 25*b* and the inner portion of nozzle orifice 23*a*. In this space, the fuel is set into a whirling motion and atomized. The fuel then leaves the nozzle as a mist and flows through the orifice 23*a*, approximately as indicated in FIG. 1 at 11, within a conical space, through aperture 9*a* of baffle plate 9 out of the burner head. Air is supplied through flame tube 1, as indicated by arrows 13 in FIG. 1. The air mixes with the fuel mist, so that the fuel is combusted.

The burner nozzles are intended particularly for the heating equipment of single-family houses or vehicles, for example, driver cabins of trucks. In such applications, about 1 to 5 kg of fuel per hour are consumed, the fuel being either fuel oil or diesel oil. In such burner nozzles, the depth a and the width b of vortex-body channels 25*c* are less than 0.5 mm, usually about 0.1 to 0.3 mm, depending on the wanted heating capacity. The dimensions a and b are approximately equal to each other, so that channels 25*c* have about a square cross section. Grooves 27*e* are so proportioned to the design of the vortex body that their maximum sectional area is smaller than the maximum sectional area of channels 25*c*. More particularly, the maximum depth d and maximum width w of the grooves are smaller than both the channel depths a and the channel width b. Depending on the provided burner capacity, the depth t of grooves 27*e* is smaller than 0.15 mm, preferably smaller than 0.07 mm. It may be about 0.03 to 0.05 mm, for example. The width w of grooves 27*e* is about twice their depth t. Consequently, depending on the provided burner capacity, the maximum width w of the grooves is smaller than 0.3 mm, preferably smaller than 0.15 mm and, for example, 0.05 to 0.1 mm. Otherwise, the manufacturing tolerances of outer body 21 and of pin 27 are defined to the effect that the teeth 27*f* bounding the grooves 27*e* either contact the inside surfaces of the outer body or that maximum radial clearances are allowed therebetween which are smaller than the groove depth, and amount of about 0.01 mm at most.

In consequence, dirt particles present in the fuel and having passed through screen 31 or entrained from the further passages through which the fuel flows, are intercepted to a large extent at the entrance of grooves 27*e*. In particular, intercepted are any dirt particles which could clog channels 25*c*. This makes it possible to use burner nozzles with very small channel cross sections. This further permits to provide small diameters of the nozzle body, vortex body, and the outer body, which is important with low heating capacities, in order to obtain a satisfactory efficiency.

An accumulation of dirt particles at the entrance of grooves 27*e* may clog individual grooves. However, in view of the great number of grooves 27*e*, the free passage area for the fuel still remains sufficiently large, even if some of the grooves are clogged.

FIG. 7 shows a modified design of a pin 127 corresponding to pin 27, which may be received in outer body 21 as a substitute for pin 27. Pin 127 differs from pin 27 in that not a single circular row of grooves, but three portions 127*d*, 127*m*, 127*n* each with a circular row of grooves 127*e* around the pin, are provided between annular groove 127*c* which communicates with longitudinal hole 127*g* through radial bores 127*h* and the front face turned to the vortex body of pin 127. Annular grooves 127*p* and 127*q*, in which the fuel can flow around the circumference of the pin, are provided between the respective portions 127*d*, 127*m* and 127*n* following each other.

The burner nozzle 205 shown in FIG. 8 comprises an outer body 221. A nozzle 223 having a nozzle orifice 223*a*, a vortex body 225, and a pin 227 are received in the longitudinal hole 221*a* of body 221. Pin 227 presses vortex body 225 into contact with nozzle body 223. The front face 225*a* of vortex body 225 opposite to the nozzle body is conically tapered, provided with channels 225*c*, and projects into the nozzle orifice 223*a* whose inner portion forms the vortex space 245. Vortex body 225 is provided on its circumferential surface with a circular row of grooves 225*e* which extend in the axial direction and correspond in their function to grooves 27*e* of the first embodiment described above. The pin portion 227*c* adjacent the vortex body 225 has a smaller diameter than the following, cylindrical pin portion 227*b* and longitudinal hole 221*a*, so that an annular cavity 241 is formed between the outer surface of end portion 227*c* and the inner surface of longitudinal hole 221*a*. Pin 227 has a longitudinal bore 227*g* which communicates with cavity 241 through radial bore 227*h*. Cavity 241 communicates through grooves 225*e* with an annular cavity 243 which surrounds the vortex body 225 in the zone of the outer ends of channels 225*c*.

The grooves 127*e* of pin 127 shown in FIG. 7 and the grooves 225*e* of the vortex body 225 shown in FIG. 8 are of analogous design and their dimensions are identical with those of grooves 27*e* of the first embodiment of the burner nozzle, so that their filtering effect is similar.

Grooves 27*e*, 127*e* and 225*e* may be produced by means of an impact slotting tool, for example.

The cross-sectional shapes and dimensions of the grooves may, of course be modified in different ways and it is not necessary that the grooves extend exactly parallel to the longitudinal axis of symmetry of the burner nozzles. However, the grooves must provide a connection between two annular cavities of which one communicates with the peripheral ends of the channels serving to produce the whirling motion and the other communicates with the passage or passages through which the fuel is supplied.

It would further be possible, instead of providing the grooves on the circumferential surfaces of the vortex body or the pin through which the fuel is supplied, to provide them on the inside surface of the outer body.

Also, instead of providing the channels intended for producing the whirling motion in a vortex body, they might be provided on the inner front face of the nozzle body.

I claim:

1. A burner nozzle comprising an outer body having a longitudinal bore extending therethrough from an entrance end to an exit end for passing a fuel therethrough, a nozzle body mounted in said bore adjacent said exit end, said nozzle body having an orifice coaxially disposed in respect to the axis of said longitudinal bore for passing the fuel, a vortex body mounted in said bore spaced from said outer body to provide a first annular cavity between said outer body and the periphery of said vortex body, said vortex body having a front face designed for reception on said nozzle body, said front face having a tapering pocket immediately adjacent to and in alignment with said orifice and at least one channel interconnecting said first annular cavity and said tapering pocket, and a pin member mounted in said bore, said pin member having a passage for supplying fuel to said nozzle body, said pin member having an annular groove near an end thereof adjacent said vortex body to provide a second annular cavity between said outer body and the periphery of said pin member, said pin member having a surface portion intermediate said second annular cavity and said first annular cavity, said surface portion contacting a surface portion of said outer body bounding said bore, said surface portion having plurality of grooves interconnecting said first annular cavity and said second annular cavity and wherein the sectional area of said grooves is smaller than the sectional area of said channel.

2. A burner nozzle according to claim 1, wherein the maximum sectional dimension of said grooves is smaller than the maximum sectional dimension of said at least one channel.

3. A burner nozzle according to claim 2, wherein said grooves extend in the longitudinal direction of the longitudinal bore of said outer body.

4. A burner nozzle according to claim 3, wherein said grooves have a depth measured radially to the longitudinal axis of said longitudinal bore of said outer body is not greater than 0.15 mm.

5. A burner nozzle according to claim 4, wherein the depth of the grooves is 0.07 mm at the most.

6. A burner nozzle according to claim 5, wherein said one of said surface portions includes at least 30 grooves distributed thereover at spaced intervals.

7. A burner nozzle according to claim 2, wherein said grooves have a depth measured radially to the longitudinal axis of said longitudinal bore of said outer body is not greater than 0.15 mm.

8. A burner nozzle according to claim 7, wherein the depth of the grooves is 0.07 mm at the most.

9. A burner nozzle according to claim 8, wherein said one of said surface portions includes at least 30 grooves distributed thereover at spaced intervals.

10. A burner nozzle according to claim 3, wherein said surface portion of said pin member has said plurality of grooves.

11. A burner nozzle according to claim 2 wherein said one of said surface portions includes at least 30 grooves distributed thereover at spaced intervals.

12. A burner nozzle according to claim 11, wherein said passage has at least one radial inlet port and further comprising a filter surrounding said pin member.

13. A burner nozzle according to claim 12, wherein said grooves have a length at least three times their depth and their width.

14. A burner nozzle according to claim 2, wherein said grooves have a length at least three times their depth and their width.

15. A burner nozzle according to claim 1, wherein said grooves have a maximum width measured transversely to the longitudinal axis of said longitudinal bore of said outer body and transversely to a radius to said axis that is smaller than 0.15 mm.

16. A burner nozzle comprising:

an outer body having a longitudinal bore extending therethrough from an entrance end to an exit end, a nozzle body mounted in said bore adjacent said exit end, said nozzle body having an orifice for passing a fuel extending therethrough coaxially disposed in respect to the axis of the longitudinal bore with a vortex pocket communicating with said orifice on one side of the nozzle body, an elongated pin member mounted in said bore having a pin portion cooperating with said outer body to provide a first annular cavity therebetween and a passage for supplying fuel from said entrance end to said first annular cavity, groove means intermediate said pin portion and said nozzle body and cooperating with said nozzle body and said outer body to provide a second annular cavity, said groove means including a plurality of grooves interconnecting said first annular cavity and said second annular cavity, said grooves extending in the longitudinal direction of the longitudinal bore, said grooves being disposed at circumferentially spaced intervals, channel means for passing fuel from said second annular cavity to said vortex pocket, and wherein the maximum sectional dimension of said grooves is smaller than the maximum sectional dimension of said channel means and the sectional area of the grooves is smaller than the sectional area of the said channel means.

17. A burner nozzle according to claim 16, wherein said grooves have a depth measured radially to the longitudinal axis of said longitudinal bore of said outer body is not greater than 0.15 mm.

18. A burner nozzle according to claim 17, wherein the depth of the grooves is 0.07 mm at the most.

19. A burner nozzle according to claim 18, wherein said one of said surface portions includes at least 30 grooves distributed thereover at spaced intervals.

20. A burner nozzle according to claim 19, wherein said grooves have a length at least three times their depth and their width.

21. A burner nozzle according to claim 16, wherein said groove means are provided on an outer surface of said pin member.

22. A burner nozzle according to claim 16, wherein said grooves have a maximum width measured transversely to the longitudinal axis of said longitudinal bore of said outer body and transversely to a radius to said axis that is smaller than 0.15 mm.

23. A burner nozzle according to claim 16, wherein said pin portion includes at least 30 grooves distributed thereover at spaced intervals.

24. A burner nozzle according to claim 16, further comprising a separate intermediate member intermediate said pin member and said nozzle body and, wherein said groove means are provided on said separate intermediate member.

25. A burner nozzle according to claim 24, wherein said channel means are provided in said intermediate member.

* * * * *